US008277572B2

(12) United States Patent
Falster-Hansen

(10) Patent No.: US 8,277,572 B2
(45) Date of Patent: Oct. 2, 2012

(54) DRIVE UNIT IN PARTICULAR FOR USE IN CONNECTION WITH TANK CLEANING EQUIPMENT

(75) Inventor: Henrik Falster-Hansen, Ishoj (DK)

(73) Assignee: Alfa Laval Tank Equipment A/S, Lund (SE)

( * ) Notice: Subject to any disclaimer, the term of this patent is extended or adjusted under 35 U.S.C. 154(b) by 1226 days.

(21) Appl. No.: 11/570,577

(22) PCT Filed: Feb. 1, 2005

(86) PCT No.: PCT/DK2005/000072

§ 371 (c)(1),
(2), (4) Date: Jan. 30, 2008

(87) PCT Pub. No.: WO2006/000216

PCT Pub. Date: Jan. 5, 2006

(65) Prior Publication Data

US 2008/0247861 A1 Oct. 9, 2008

(30) Foreign Application Priority Data

Jun. 23, 2004 (DK) ..... 2004 00182 U

(51) Int. Cl.
*B08B 3/02* (2006.01)

(52) U.S. Cl. ..... 134/167 R; 134/168 R; 134/181; 239/227

(58) Field of Classification Search ..... 134/167 R, 134/188 R, 180, 181, 168, 181 R; 239/227
See application file for complete search history.

(56) References Cited

U.S. PATENT DOCUMENTS

| | | | | |
|---|---|---|---|---|
| 3,584,790 | A * | 6/1971 | Bonfield | 239/227 |
| 3,874,594 | A * | 4/1975 | Hatley | 239/227 |
| 5,351,885 | A * | 10/1994 | Manabe | 239/73 |
| 5,871,023 | A | 2/1999 | Sherman, Jr. et al. | |
| 2004/0089329 | A1 * | 5/2004 | Bijster | 134/167 R |

FOREIGN PATENT DOCUMENTS

| | | | |
|---|---|---|---|
| EP | 0723909 | A1 | 7/1996 |
| WO | WO9417922 | A1 | 8/1994 |
| WO | WO2004007274 | A1 | 1/2004 |

* cited by examiner

*Primary Examiner* — Frankie L Stinson
(74) *Attorney, Agent, or Firm* — Fish & Richardson P.C.

(57) ABSTRACT

To ensure that liquid and/or vapors do not escape from a tank space during cleaning by means of cleaning equipment, a housing (2) is provided with magnetic coupling equipment according to the invention, comprising two cooperating pole elements (8,9) which extend hermetically isolated from each other with pole parts extending in the turbine housing (3) on the tank space side and the gear housing (1) itself outside the tank space, respectively. This provides a considerable degree of security against liquid and gas leakage, while making it possible to achieve a compact structure with easy access for service and maintenance.

8 Claims, 2 Drawing Sheets

DRIVE UNIT IN PARTICULAR FOR USE IN CONNECTION WITH TANK CLEANING EQUIPMENT

STATE OF THE ART

Figure 1:
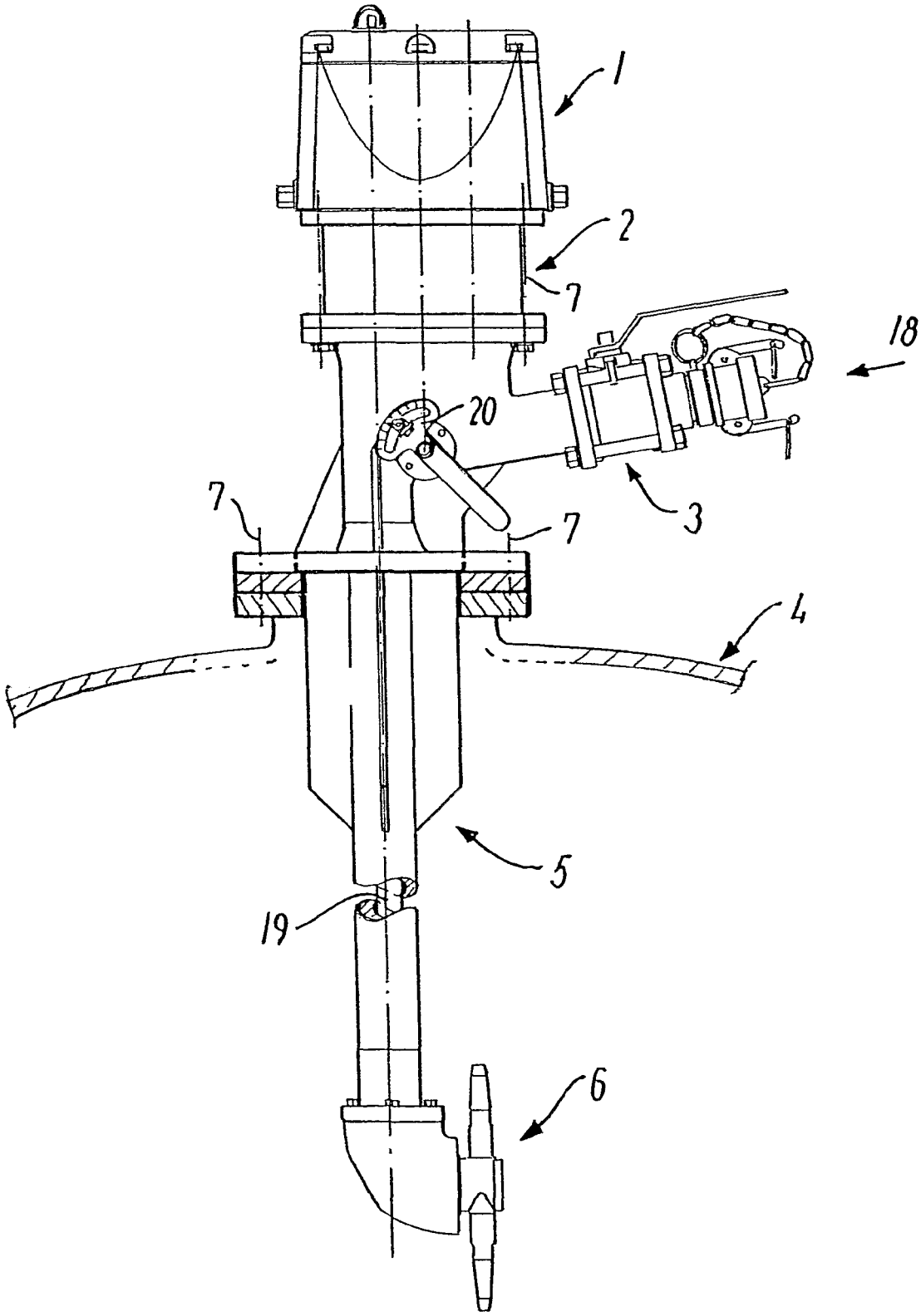

The invention relates to a drive unit in particular for use in connection with a tank cleaning device, wherein a cleaning liquid is supplied under pressure to a turbine wheel which rotates an input shaft to a gear box for reduced rotation of the output shaft thereof, said output shaft rotating a tank cleaning device with nozzles lowered down into the tank space, and wherein the torque from the output shaft of the turbine shaft as well as of the gear box is transferred by means of magnetic forces between magnetic poles on cooperating magnetic parts.

Equipment of this type is generally known and operates well in connection with the cleaning of tank spaces whose contents are of such a nature that leakage of liquid and/or vapour does not pollute the surroundings.

Where, however, the equipment is to operate in connection with tank spaces where dangerous or undesired leakage cannot be accepted owing to the environment, special equipment must be used.

The specification of U.S. Pat. No. 5,871,023 discloses a cleaning device where the drive unit is built together with the nozzle arrangement itself such that it may be lowered and mounted as a unit in the tank space.

Liquid is supplied under pressure to a turbine wheel which rotates an input shaft to a gear box for reduced rotation of an output shaft which rotates the nozzles.

The torque from the turbine shaft as well as from the input shaft of the gear box is transferred by means of magnetic couplings with cooperating magnetic poles.

This structure is vitiated by the drawback that it is lowered completely into the tank space and therefore cannot be serviced or repaired without total separation of the system.

To remedy this defect, it is known from the specification of WO 2004/007274 A1 to construct the cleaning equipment such that the drive unit is arranged outside the tank space and thereby isolated from it with respect to leakage from the tank space.

The drive unit is thus separated from the driving parts by means of a magnetic coupling which is inserted between the turbine wheel and the input shaft in the gear. Hereby, the torque of the turbine is transferred via the magnetic coupling, which provides for liquid- and gastight sealing of the tank space, thereby preventing environmentally harmful leakage from the tank space.

This known structure, however, is associated with some drawbacks and defects. First and foremost, it is only the turbine part which is isolated, and the possibility of leakage via the movable parts from the gear and the driving shaft to the nozzle head arranged in the tank space is still present.

The cleaning liquid is supplied to a hollow pipe which surrounds the shaft, and which impedes isolation from the surroundings because of the direct mechanical connection between the output shaft of the gear and the shaft in the tank space.

The specification of EP 0 723 909 discloses a structure where two magnetically transferring magnetic couplings are mounted in a housing each. This involves a complicated mechanical structure, which it is difficult to configure—in a compact manner because of the separation of the coupling parts from the drive unit and the gear unit, respectively.

To this should be added that it is a drawback in the repair and service of the equipment that it comprises partly a turbine part with magnetic coupling parts and partly the mechanical connection between the output shaft of the gear and the rotary part for the nozzle head. To this should be added a complicated liquid supply, bypass, from the turbine drive and to the pipe.

OBJECTS OF THE INVENTION

The object of the invention is to remedy these drawbacks and deficiencies, and this is achieved according to the invention in that the torque-transferring magnetic parts are mounted in a housing on which the gear box and the turbine housing are mounted.

Thus, when, according to the invention, the magnetic poles are arranged in a separate housing, mounting can be carried out easily when the housing is mounted between the part of the equipment present in the liquid flow and the gear unit itself.

Hereby, a compact structure and an easy separation of the parts for service and repair may be achieved.

When, as stated in claim 2, the parts may be separated in a generally known manner by means of flange joints and gaskets, complete liquid and gas separation between parts extending in open communication with the tank space and the parts present outside the tank space is achieved.

When, as stated in claim 3, pole parts extending in the longitudinal direction of the axes of rotation are used, they will be able to transfer a relatively great torque without any risk of the cooperating poles being put out of balance.

When, as stated in claim 4, the magnetic part, extending from the gear, in the coupling housing is provided with an axially displaceable coupling part, the shaft, in addition to its rotation, may also be moved in an axial direction so that the nozzle head may be adjusted in a known manner with respect to the plane of rotation of the nozzles.

Finally, as stated in claim 5, it is expedient to use components such as coupling parts with axially extending teeth or grooves to achieve the combined rotary and axially displaceable movement.

THE DRAWING

Figure 2:
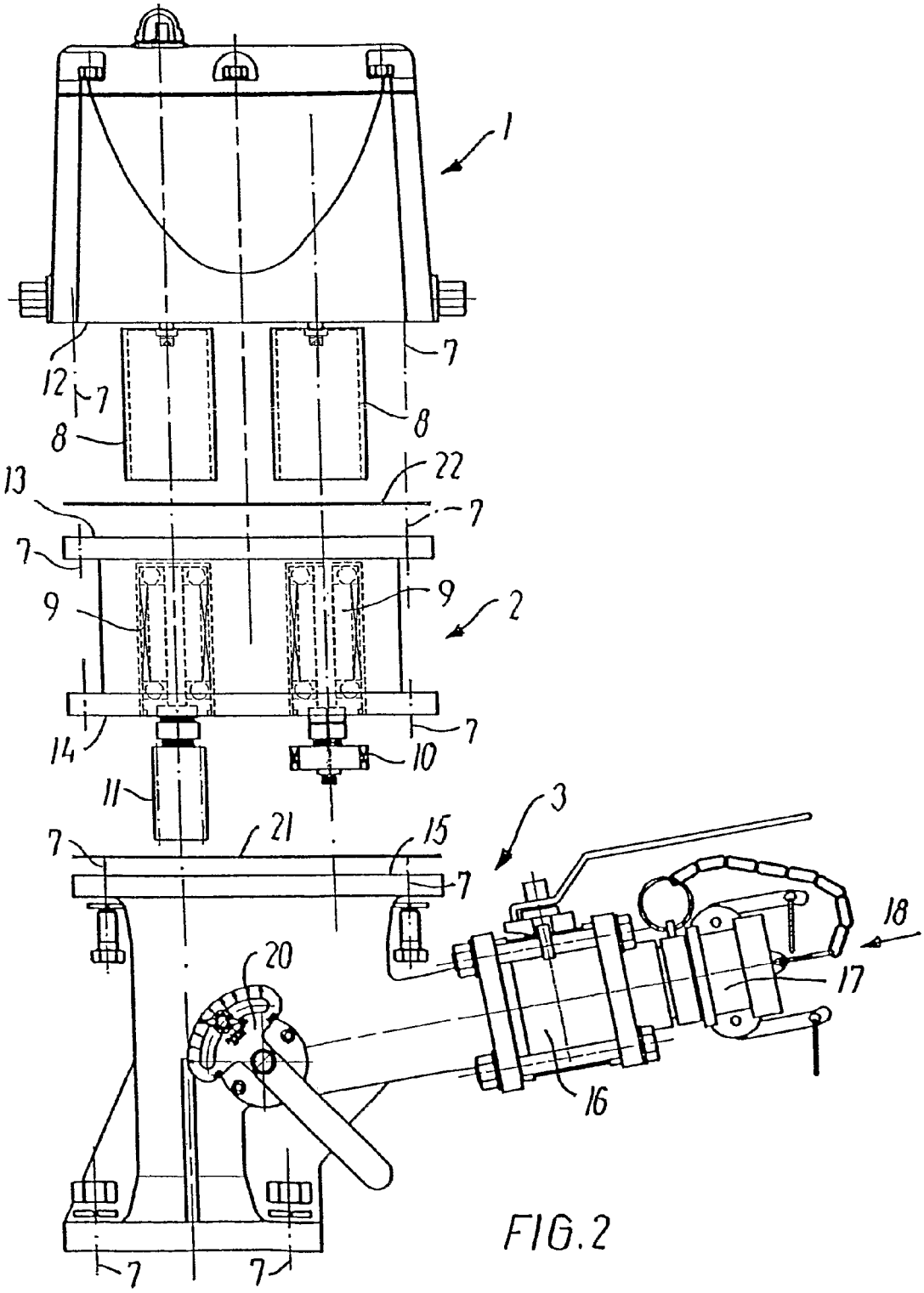

An exemplary embodiment of the equipment according to the invention will be described more fully below with reference to the drawing, in which FIG. 1 shows the equipment seen from the side, mounted on a tank, and FIG. 2 shows a partially sectional view of the parts in a separated state.

DESCRIPTION OF AN EXEMPLARY EMBODIMENT

FIG. 1 shows an example of a preferred embodiment of the equipment comprising a pipe part 5 which extends in a tank and has a pivotable and rotating nozzle head 6 at the end. As indicated in the drawing, a rotary shaft 19 extends in the pipe part 5, just as the supplied cleaning liquid to the nozzle head is conveyed through the pipe.

The equipment mounted externally on the tank 4 comprises a generally known head 3 with supply means 17 for cleaning liquid under pressure 18, said cleaning liquid being conveyed through the head in which a turbine head 18 to generate a rotating movement is mounted.

This movement is transferred via a magnetic coupling in a housing 2 to a gear box 1, where the number of revolutions from the turbine head is reduced and transferred via another magnetic coupling to the shaft 19.

As will appear from FIG. 1, all the parts are fixed together to provide a compact drive unit with the two axes of rotation extending mutually in parallel with a short mutual spacing.

A more detailed description of the drive unit will be given with reference to FIG. 2 which shows the parts in a separated state.

As mentioned, the rotary movement is generated by a turbine wheel 10 which is disposed in the liquid flow 18 in the housing 3. The turbine part may be arranged to be adjustable with respect to efficiency and thereby be adapted to the need for torque.

This may take place in a generally known manner by constructing a conical turbine wheel such that it is adjusted in its axial position and is thereby dependent on the flow of the water.

This turbine wheel 10 is connected with a cylindrical magnetic head 9 via a shaft, which head comprises a plurality of axially extending magnetic parts.

A cylindrical jacket with pole parts 8 with oppositely poled magnets relative to the core 9 extends around the magnetic part 9.

This outer magnetic part 8 is connected with the input shaft of the gear 1, while the output shaft of the gear is connected with another magnet 8 which extends around a cooperating pole part 9.

This pole part 9, in turn, is connected with a coupling part 11 which, together with the turbine wheel 10, extends in the liquid space in the housing 3.

These three parts 1, 2, 3 may be fixed together to form the drive unit shown in FIG. 1 by means of cooperating flange formations 12, 13, 14, 15, fixing means 7 and gaskets 21, 22. The gear box 1 and/or the housing 2 may hereby be separated from the turbine housing 3 without any risk of leakage of liquid and/or gases from the tank space, as the gasket 21 ensures the tight joint between the housing 2 and the turbine housing 3.

A stop valve 16 and coupling means 17 are provided in a generally known manner in the housing for the liquid supply 18.

Moreover, an adjustment device 20 for adjusting the liquid supply to the nozzles 6 and/or its movement is shown on the housing 3 itself.

The connection between the magnetic coupling part 9 and the shaft 19 25 takes place via an axially displaceable coupling 11, which may e.g. be a toothed wheel in displaceable engagement with a receiving part (not shown) with internal toothing which is secured to the end of the shaft 19.

When the parts are fixed together, as shown in FIG. 1, complete liquid and/or gas tightness will be established from the space in the tank 2 and the surroundings, as there is no direct contact between the magnetic coupling 7 parts 8, 9, which will extend outside and in contact with the tank space and the liquid supplied, respectively.

Since all the movable parts are readily accessible by separation of the components, it is possible to perform service, just as replacement of worn or damaged parts may easily be carried out.

The invention claimed is:

1. A drive unit for use in connection with a tank cleaning device, the drive unit comprising:

a turbine wheel, driven by a cleaning liquid supplied under pressure, which rotates an input shaft to a gear box for reduced rotation of an output shaft thereof, said output shaft rotating a cleaning device with nozzles lowered down into a tank space, torque from the output shaft of the turbine shaft as well as of the gear box transferred by means of magnetic forces between magnetic poles on cooperating magnetic parts, the torque-transferring magnetic parts being mounted in a housing on which the gear box and a turbine housing are mounted;

wherein the magnetic parts comprise a cylindrical magnetic part and a pole magnetic part extending around the cylindrical magnetic part.

2. A drive unit according to claim 1, further comprising:

a gasket mounted between the housing and the turbine housing for liquid and/or gastight separation between the tank space and the housing.

3. A drive unit according to claim 2, wherein the output shaft of the gear box transfers the torque via a coupling part secured to the pole magnetic part, said part being in rotatable and axially displaceable connection with a receiving part secured on the rotating shaft of the cleaning device.

4. A drive unit according to claim 3, wherein the coupling part and the receiving part are formed with teeth and grooves or cooperating tracks.

5. A drive unit according to claim 2, wherein the output shaft of the gear box transfers the torque via a coupling part secured to the pole magnetic part, said coupling part being in rotatable and axially displaceable connection with a receiving part secured on the rotating shaft of the cleaning device.

6. A drive unit according to claim 5, wherein the coupling part and the receiving part are formed with teeth and grooves or cooperating tracks.

7. A drive unit according to claim 1, wherein the output shaft of the gear box transfers the torque via a coupling part secured to the pole magnetic part, said coupling part being in rotatable and axially displaceable connection with a receiving part secured on the rotating shaft of the cleaning device.

8. A drive unit according to claim 7, wherein the coupling part and the receiving part are formed with teeth and grooves or cooperating tracks.

* * * * *